United States Patent [19]

Öberg

[11] Patent Number: 4,741,089

[45] Date of Patent: May 3, 1988

[54] METHOD OF PRODUCING CONTAMINANT RESTRAINING BOOMS AND THE LIKE

[76] Inventor: Per O. Öberg, P.O. Box 898, S-914 00 Nordmaling, Sweden

[21] Appl. No.: 879,647

[22] Filed: Jun. 27, 1986

[30] Foreign Application Priority Data

Jul. 12, 1985 [SE] Sweden ..... 8503465

[51] Int. Cl.[4] ..... E04C 3/30

[52] U.S. Cl. ..... 29/463; 29/155 R; 52/731

[58] Field of Search ..... 29/446, 463, 155 R; 52/731, 732, 730, 574

[56] References Cited

U.S. PATENT DOCUMENTS 3,490,190 1/1970 See ..... 52/730

3,694,990 10/1972 Pamer ..... 29/463 X

FOREIGN PATENT DOCUMENTS 344088 2/1972 Sweden .

*Primary Examiner*—Howard N. Goldberg

*Assistant Examiner*—Joseph M. Gorski

*Attorney, Agent, or Firm*—Flynn, Thiel, Boutell & Tanis

[57] ABSTRACT

A method of producing a contaminant restraining boom, comprising an expandable buoyant body divided into chambers formed by joining together side members (2,3) and distributed along the boom. The side members are provided with chamber partitioning walls formed by partition members (7,8) each fastened transversely to the respective side member along a partition member edge (9) having a length substantially equal to the width of the side member, the edges (9) fastened to the respective side members being opposed to each other and in register, whereafter the opposed partition members are mutually attached along their free edges (15,16,17), whereafter the side members are tightly joined together along their outer edges together with the outer portions of the partition members.

7 Claims, 2 Drawing Sheets

METHOD OF PRODUCING CONTAMINANT RESTRAINING BOOMS AND THE LIKE

A contaminant restraining boom generally comprises an elongate buoyant body divided into a plurality of chambers. Particularly in the production of large booms, it is necessary to build them up by joining together two or more side members made from such as fabric-reinforced plastics material, which are welded together. The pieces of material used to form the partition walls of the chambers must be configured and applied so that they do not affect the expansion conditions for the body. The attachment of the partition walls is consequently critical, and the work operations in connection therewith have always been troublesome.

The problems here are added to by the need of attaching expander means for the chambers substantially at the same time. From the aspect of assembly, the expander means should be divided into halves, which must be fitted directly opposite each other before the side members are welded together. This is also a time-consuming operation, particularly with long material webs, and it is difficult to achieve good precision.

The present invention relates to a method of solving the problems mentioned above, and substantially resides in that each of the partition walls is formed by two pieces of material, hereinafter called partition members, each member being attached along one long edge to its respective side member, and transversely thereto. The free edges of two partition members, which are attached to their respective side members, are then joined to each other, whereby the side members will be mutually oriented. Before joining the partition members together the halves of the expander means are positioned at given spacing relative to the attachment edges of the partition members distributed along the respective side member. When the partition members are subsequently joined together, as mentioned above, both side members will be completely oriented relative each other, and consequently, when the side members are stretched out the respective expander halves will automatically come opposite each other. The halves of the expander means can thus be joined together and locked in a collapsed condition, after which the long edges of the side members can be joined together. The partition members substantially extend right out to the long edges of the side members so that when the long edges of the side members are joined together a seal and a defining wall are formed by the partition members, thus forming chambers in the future buoyant body. The joined-together partition members project funnel-like into the respective adjacent chamber, i.e. the partition walls between chambers will not be completely flat even in an expanded state of the boom.

What is characterizing for the invention is apparent from the following claims.

The invention will now be described in detail, with reference to the accompanying drawings, which schematically illustrate an embodiment of the invention.

Figure 1:
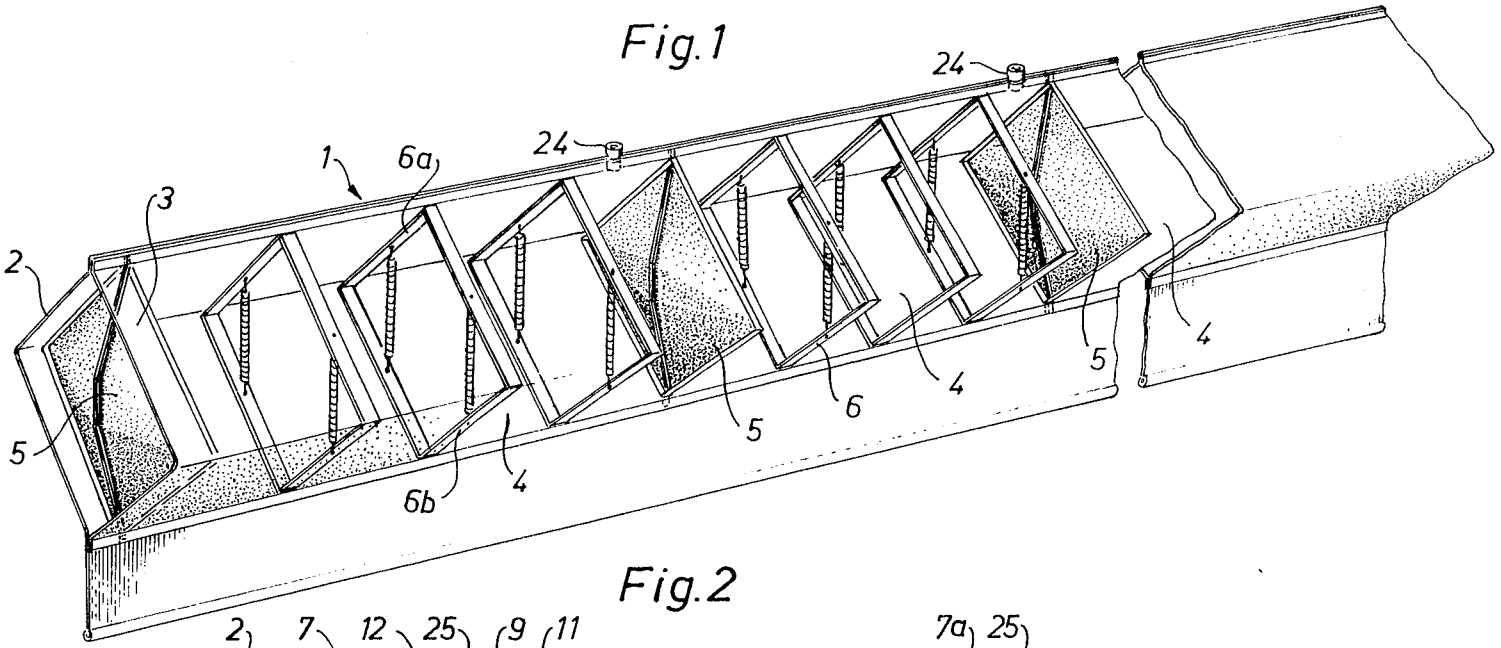
FIG. 1 is a fragmentary perspective view of the boom, with certain sections removed and its associated skirt only indicated.
Figure 2:
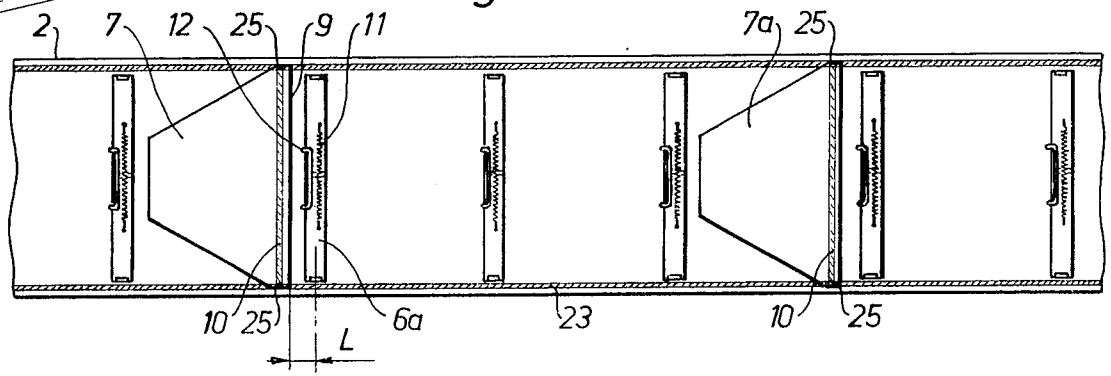
FIG. 2 is a view seen from above of a part of one side member of the boom.

The construction of a boom will be understood by reference first to FIG. 1, in which a boom section is depicted in perspective, with a part of one of the two side members 2,3 made transparent for the sake of clarity. As will be seen, every boom section is divided into a plurality of chambers 4, which are separated by partition walls 5. In each chamber there is a plurality of preferably three expander means 6. These expander means are disposed on the inside of the respective side member, which makes assembly troublesome. To facilitate fabrication of the boom, the expander means is divided into two halves *6a,6b*, of which one *6a* is attached to the inside of the side member 2 transverse the longitudinal direction thereof, while the other half *6b* is attached to the inside of the side member 3 in register with the first half. It is important that the positions of both halves is such that they coincide when the boom is assembled, so that both halves can be joined together to form a complete expander means 6. Up to now this has been a large problem, but with the aid of the present invention this problem is solved in a very simple way. As already mentioned, the boom contains a plurality of partition walls 5. In accordance with the invention every partition wall 5 comprises two partition members 7,8, of which one 7 is joined to the side member 2 and the other 8 to the other side member 3 along one of the sides of the respective partition member. FIG. 2, in a view from above, illustrates a part of the side member 2 of the boom 1. A substantially trapezoid-shaped (i.e. a figure with two parallel sides) partition member 7 is placed on the inside of the side member and is welded to it substantially along the whole of the base line 9 of the position member. In the Figure the weld is given the reference numeral 10. Strating from the position for placing the partition member 7 in relation to the side member 2, one half *6a* of an expander means is mounted on the side member at a given distance L from said position. A given number of preferably three such halves are mounted on the side member at given spacing, subsequent to which a new partition member *7a* is applied to the side member 2 in a similar way as for the partition member 7. The process is repeated until the entire side member 2 has been provided with a given number of partition members and expander halves. So that each such half, which is provided with a tension spring 11, will not fold up about a hinge joint disposed at the middle of the half, it is provided with a temporary catch 12 taking the form of a long rod attached to the half with the aid of a not more closely illustrated wishbone element. The expander halves are kept flat against the inside of the side member in this way.

The other side member 3, necessary for forming a boom, is provided with a corresponding number of partition members 8 and expander means halves 60 in a similar manner.

Figure 3:
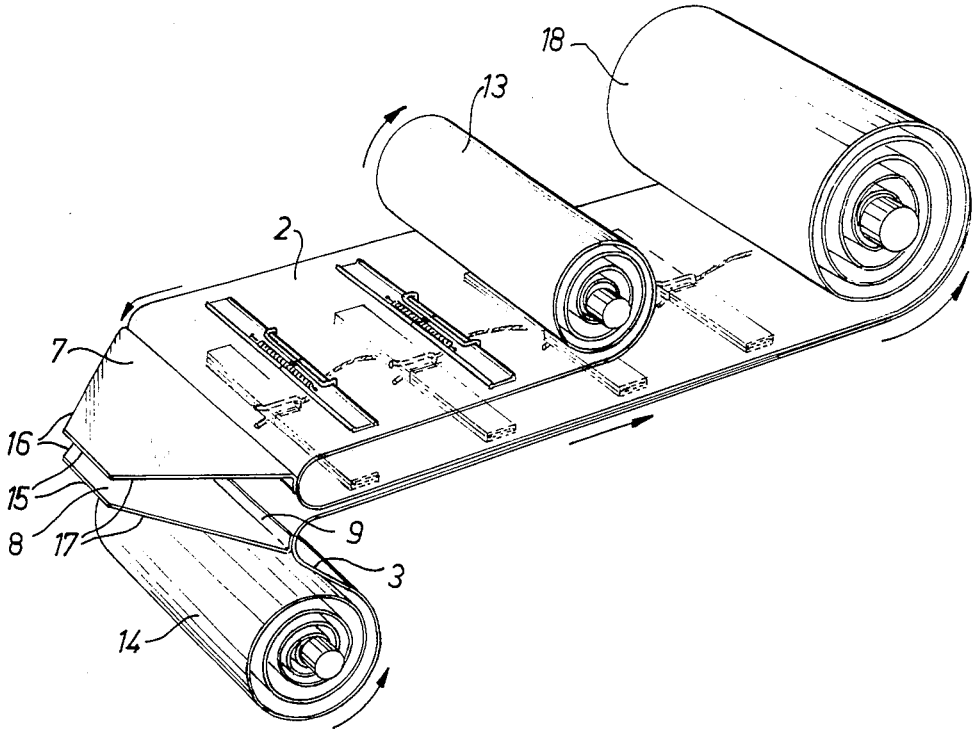
FIG. 3 is a perspective view of showing how associated partition members are arranged to form a partition wall.
Figure 4:
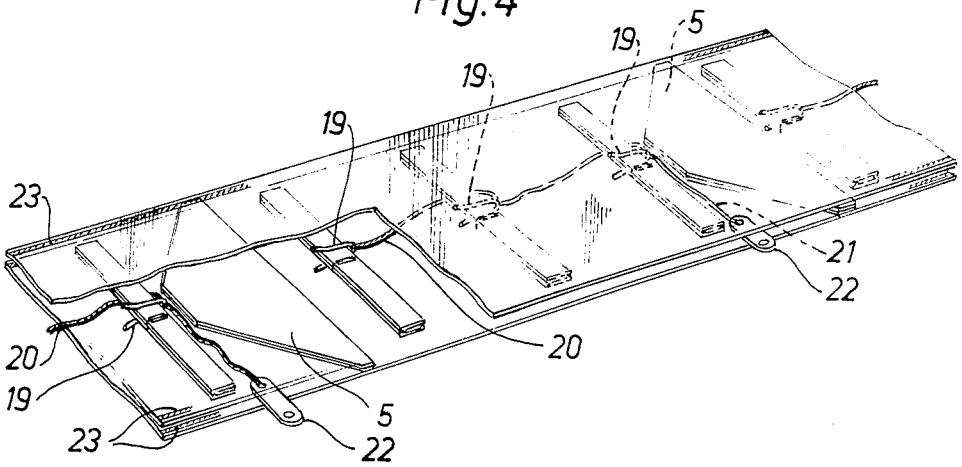
FIG. 4 is a partially broken perspective view of the boom before the side members are welded together.

It will be clear from FIG. 3 how putting together the partition members 7,8 of both side members 2,3 takes place for mutually joining both side members. Each side member 2,3 is rolled up on its respective storage roll 13,14. One roll 13 is arranged above the other 14 so that a passage is formed between them, through which are allowed the partially mutually joined side members 2, 3. In accordance with the invention, each side member is pulled from the respective storage roll into an unillustrated assembly table or the like. The partition members 7, 8 of the respective side members are then arranged so that the mutually facing surfaces of the partition members 7, 8 are in mutual register. Using a welding process, both partition members 7, 8 are now joined to each other first along the sides 15 parallel to the respective base edge 9, which is joined to the respective side member, as described earlier. During joining it is important that the free edges of the partition members 7, 8 are exactly in line with each other, since the edges of the expander halves associated with one side member will thus be automatically in register with their complemental expander halves associated with the other side member. After welding the side members along the sides 15, they are also joined by welding along their other free edges 16,17. A partition wall 5 is thus formed, which has a conical shape on its expanded state.

Both side members 2,3, are now rolled up onto a common storage roll 18 while they are advanced from their respective storage rolls 13,14 until the next pair of partition members are in position on the assembly table. These members are then mutually joined in the manner just described.

When all the partition members associated with a boom have been joined together in pairs to form the partition walls in the boom, the storage roll 18 is transferred to a flat table, on which the boom is rolled out. Dure to the accurate, mutual orientation of the partition members 7,8 of the respective partition walls, the inwardly facing expander halves of the upper side member will be directly above the expander halves arranged on the inside of the lower side member. Two thus opposed expander halves *6a, 6b* may then be readily joined to each other at their free ends, e.g. by riveting, such as to form an expander means 6. The temporary catches 12 with their associated wishbone elements are removed and replaced by wishbone members 19, which keep the expander means 6 in a flat state. All the wishbone members 19, arranged in a common chamber defined by two consecutive partition walls 5, are in common communication via a cord 20, or the like, which is attached at its free end 21 to a teflon plate 22. This plate is placed between the two side members 2, 3 so that its end with the cord 20 attached projects into the chamber, and its other end projects outside the longitudinal edge of the side members. Both side members 2, 3 are then welded to each other along their longitudinal edges. The partition members 7, 8 of each partition wall have a width such that they are also welded along a portion of their base surface to the side members 2, 3 along the longitudinal weld. For clarity, the latter weld is illustrated hatched in FIG. 2 and has been given reference numeral 23. In this way an airtight chamber 4 is obtained between two partition walls 5. The side members are not welded at the location of the teflon plate, thus allowing the formation of an opening to which a valve means 24 (FIG. 1) is applied and welded, after the wishbone members 19 have been readily withdrawn from the interior of the boom with the aid of the cord 20, through the openings formed by the teflon plates. In order that the boom will not expand when wishbones are removed, a stay, e.g. a beam (unillustrated) is arranged above the boom parallel to its centreline. For transport, the air is evacuated from the chambers and the boom rolled up and packaged.

What is claimed is:

1. Method of producing a contaminant-restraining boom, comprising an expandable buoyant body, such boom being formed by joined side members and being divided by partition walls into chambers distributed along the boom, comprising the steps:

providing side members each with respective partition members, namely by attaching an edge of a given said partition member to extend transverse to a respective said side member, the attached edge of the partition member having a length substantially the same as the width of the respective side member;

at a given distance (L) from the attached edge of a respective partition member, applying to a given side member a part of an expander means for opposition to and coaction with a corresponding expander means part similarly applied to a corresponding place on an opposing side member, each expander means part being spring biased toward an erected state and locked in a collapsed state by removable catch members, the catch member being connected to each other by a cordlike member;

opposing the side members and thereby placing in opposed register the partition members on the opposed side members;

joining together the opposed partition members along free edges thereof, and thereby causing each pair of opposed partition members to form a partition wall to separate two chambers in the boom and to hold the side members in opposed register;

bringing into coaction opposed parts of the expander means; and leading part of the cordlike member out sideways from between the side members at a place along their opposed side edges and therewith forming a vent for a respective chamber in the boom; and tightly joining the side members along their longitudinal outer edges while joining thereto outer portions of the partition members.

2. Method as claimed in claim 1, wherein the partition members each decrease in width, starting at the attached edge thereof.

3. Method as claimed in claim 1, wherein the partition members are of trapezoid shape, namely a four-sided figure with two parallel sides.

4. Method as claimed in claim 1, including providing the cordlike member with means for preventing said joining of the side members together at said place.

5. Method as claimed in claim 1, wherein said side members and partition members comprise a weldable plastics material, and including providing said cordlike member, at its said place of exit from between said side members, with a weld-inhibiting protective coating of.

6. Method of producing a contaminant-restraining boom in the form of an expandable buoyant body, such boom being formed by joined side members and being divided into chambers distributed along the boom, said side members having length and width dimensions, said side members having insides facing toward the interior of said chambers, comprising the steps:

welding a base edge of a trapezoid-shaped partition member to the inside of a given side member with such base edge extending widthwise of said side member and being of length substantially equal to the width of the side member, said trapezoid-shaped partition member having sloped edges extending along the length of the side member in a convergent manner and being joined by a short edge substantially parallel to said base edge and thus extending widthwise of said side member, and similarly welding plural ones of said trapezoid-shaped partition members to the inside of both side members at a common spacing and orientation;

mounting half of an expander means on the inside of a given side member at a given distance (L) from the base edge of a given said trapezoid-shaped partition member, with the half expander means extending widthwise of the side member, the half expander means having a hinge joint at the middle thereof and having a tension means tending to cause same to fold at said hinge joint and further having a temporary catch for temporarily preventing folding at such hinge joint and thereby keeping said half expander means flat against the inside of its respective side member, and similarly mounting plural ones of similarly equipped half expander means to the inside of both side members at the same given distance (L) from corresponding ones of said trapezoid-shaped member base edges;

mounting further half expander means on the insides of said side members at given longitudinal distances along said side members from the first-mentioned expander means, and thereby spacing several such expander means between each adjacent pair of trapezoid-shaped partition members on each side member, said half expander means having free ends;

placing said insides of said side members in opposed relation, with said trapezoid-shaped partition members of one in accurate registry with corresponding trapezoid-shaped partition members on the other;

welding the sloped edges and short edge of the now inregister trapezoid-shaped partition members together and therewith (1) forming a partition wall from each in-register pair of trapezoid-shaped partition members, which partition wall in its expanded state has a substantially conical shape, and (2) assuring joinder of the face-to-face side members and face-to-face register of the half expander means on one side member with respect to those on the other side member;

joining the free ends of the half expander means on one side member to the free ends of the in-register half expander means on the other side member to form corresponding full expander means from each in-register pair of half expander means;

replacing the temporary catches with wishbone members and thereby keeping the expander means in a flat state;

attaching all the wishbone members located in a common chamber defined between two consecutive partition walls serially to a cordlike member, such cordlike member having a free end which is slidably surfaced, and locating such slidably surfaced free end between opposed side edges of the in-register side members, so that such free end projects outwardly therebeyond;

welding together the in-register, longitudinally extending, side edges of the side members, the base edges of the partition members extending widthwise of the side members sufficient that the ends of such base edges are also welded in the weld of side member side edges, so as to form an airtight chamber longitudinally between each pair of partition walls, which airtight chamber is laterally surrounded by the side members, the slidably surfaced free end of the cordlike member providing a small discontinuity in the longitudinal weld joining the side edges of the side members;

withdrawing said wishbone members from each chamber by pulling same with the cordlike member through the corresponding small discontinuity in the side member side edge weld, and inserting and welding a valve means in said small discontinuity so as to allow valve communication between the chamber and the area outside the side member, and thereby forming, in a flattened condition, the desired boom.

7. Method of producing a contaminant-restraining boom, comprising an expandable buoyant body, such a boom being formed by joined side members of a flexible material, said buoyant body being divided by flexible partition walls into chambers distributed along the boom, comprising the steps:

providing adjacent surfaces of opposite side members each with a partition sheet, each said sheet having one edge thereof attached to one of said side members so as to extend transverse to that side member, the attached edge of each said sheet having a length substantially the same as the width of the attached side member;

placing the side members with said adjacent surfaces thereof in opposed register so as to achieve opposed register of pairs of said sheets;

joining together each of said opposed pairs of sheets along a free edge thereof to form a partition wall and using said partition walls to keep the side members of the boom in opposed register;

applying, to said surface of each side member, expander means parts and locating said expander means parts on one said side member for opposition to and coaction with corresponding expander means parts on the opposing side member, said expander means parts being spaced at a given distance from the nearest attached edge of said partition sheets;

forming each of a plurality of expander means by putting together opposed expander means parts on the opposite side members, said expander means parts being spring biased to expand but locked in a collapsed state by removable catch members;

connecting the catch members to each other by a cordlike member;

leading part of the cordlike member out sideways from between the side members at a place along opposed side edges of said members;

forming said leading-out place into a vent for a respective chamber in the boom; and tightly joining the side members along their opposed side edges so as to seal therewith lateral outer portions of the sheets forming the partition walls.

* * * * *

UNITED STATES PATENT AND TRADEMARK OFFICE

CERTIFICATE OF CORRECTION

PATENT NO. : 4 741 089

DATED : May 3, 1988

INVENTOR(S) : Per O. OBERG

It is certified that error appears in the above-identified patent and that said Letters Patent is hereby corrected as shown below:

Column 4, Line 18; Change "catch member being" to ---catch members being---.

Column 4, Line 50; Change "coating of" to ---coating---.

Signed and Sealed this

Twentieth Day of September, 1988

*Attest:*

DONALD J. QUIGG

*Attesting Officer*

*Commissioner of Patents and Trademarks*